United States Patent [19]

Crane

[11] 4,411,391

[45] Oct. 25, 1983

[54] DOCUMENT SHREDDING MACHINES

[75] Inventor: Dennis P. Crane, Olton, England

[73] Assignee: Ofrex Group Limited, London, England

[21] Appl. No.: 263,979

[22] Filed: May 15, 1981

[30] Foreign Application Priority Data

May 27, 1980 [GB] United Kingdom ..... 8017324

[51] Int. Cl.[3] ..... B02C 18/18

[52] U.S. Cl. ..... 241/232; 83/501; 241/236

[58] Field of Search ..... 241/230, 232, 234, 236; 83/501, 502, 503, 348

[56] References Cited

U.S. PATENT DOCUMENTS

| | | | |
|---|---|---|---|
| 571,266 | 11/1896 | Faurow | 241/232 |
| 1,522,456 | 1/1925 | Howson | 241/232 X |
| 1,980,193 | 11/1934 | Finegan | 241/23 X |
| 2,770,302 | 11/1956 | Lee | 241/236 UX |
| 3,107,869 | 10/1963 | McIntire | 241/232 |
| 3,860,180 | 1/1975 | Goldhammer | 241/236 X |
| 3,960,335 | 6/1976 | Haberle | 241/236 |
| 4,000,748 | 1/1977 | Summers | 241/236 X |
| 4,020,993 | 5/1977 | Frazerhurst et al. | 241/236 X |
| 4,140,285 | 2/1979 | Linzberger et al. | 241/232 |

FOREIGN PATENT DOCUMENTS

| | | |
|---|---|---|
| 739343 | 10/1955 | United Kingdom . |
| 771877 | 4/1957 | United Kingdom . |

*Primary Examiner*—Fred Silverberg

*Attorney, Agent, or Firm*—Merriam, Marshall & Bicknell

[57] ABSTRACT

The invention concerns a document shredding machine of the kind comprising two cutter assemblies, each assembly comprising a drive shaft upon which cutter discs are mounted at spaced intervals, the assemblies being mounted so that the discs of one assembly enter into the gaps between the discs of the other assembly with little or no clearance, the machine comprising a drive mechanism to rotate the drive shafts in opposite directions, so that the overlapping discs collectively act to cut material fed into the nip of the machine into narrow strips. One of the cutter assemblies is capable of movement away from its normal working position, whereby when thick documentary material is fed into the nip, as would otherwise tend to jam the machine, the cutter discs may be permitted to separate somewhat allowing the documentary material to pass through the machine without jamming. On completion of passage of the documentary material through the machine, the cutter discs return to their normal working positions automatically.

6 Claims, 3 Drawing Figures

DOCUMENT SHREDDING MACHINES

BACKGROUND OF THE INVENTION

This invention is concerned with improvements relating to document shredding machines, particularly of the kind comprising two cutter assemblies, each assembly comprising a drive shaft upon which cutter discs are mounted at spaced intervals, the assemblies being mounted so that the discs of one assembly enter into the gaps between the discs of the other assembly with little or no clearance, the machine comprising drive means to rotate the drive shafts in opposite directions, so that the overlapping discs collectively act to cut material fed into the nip of the machine into narrow strips. Such machines are hereinafter referred to as being of the kind specified.

In the operation of machines of the kind specified, a common problem is encountered in the shredding of paper. To maximise throughput, it is desirable to feed into the nip several sheets simultaneously, which are all cut into narrow strips. However when too many sheets are fed into the nip simultaneously, the machine will jam.

When this happens, the paper may be pulled away from the nip: however this may be difficult to accomplish, especially where the machine comprises cutting discs, each of which has a plurality of angularly-spaced notches to cut the strips transversely into short lengths. Additionally, this method of unjamming requires the incorporation of safety devices, to render the drive means incapable of operation whilst the machine is being unjammed.

Thus, it has previously been suggested to provide in a machine of the kind specified a reversing means for the drive motor, so that when jamming occurs, the direction of rotation of the cutter discs may be reversed, to eject the jammed material from between the cutter discs. However the use of reversing means adds to the cost of the machine, and under certain circumstances jamming occurs which cannot be removed even by reversing the direction of drive.

SUMMARY OF THE INVENTION

According to one aspect of the present invention there is provided a document shredding machine of the kind comprising a machine frame, two cutter assemblies each comprising a shaft mounted on the machine frame and cutter discs mounted on the shafts at spaced intervals, the shafts being substantially parallel and spaced apart a distance such that the discs on one shaft extend into the spaces between the discs on the other shaft, the machine comprising drive means mounted on the frame and which is operative to rotate the shafts in opposite directions so that documentary material fed into the nip of the machine is cut into strips by the action of the overlapping discs, the cutter assemblies being mounted on the frame so as to be capable of limited separative movement.

In this manner, when jamming occurs, the cutter assemblies may be separated, allowing the machine to be unjammed with ease, permitting continued use of the machine.

Most conveniently one of the cutter assemblies is fixed, and the other is mounted for movement away from said fixed cutter assembly from a normal working position, conveniently being mounted for such movement about a pivot axis.

Conveniently the degree of separation permitted is limited so as to maintain the cutter discs of the two assemblies in said overlapping relationship.

Conveniently the machine comprises a manually operable device to move one of the cutter assemblies or to allow one of the cutter assemblies to move away from the other by a permitted amount: preferably the amount is such as to retain gearing of said one cutter assembly, through which the cutter assembly is driven by the drive means, in engagement with the drive means. In this manner driving of both cutter assemblies may be continued during separation of the cutter assemblies.

Preferably said one cutter assembly is mounted for movement between the normal working position and a retracted position, and is spring-urged into its normal working position, and the manually operable device comprises cam means adapted to urge the said one cutter assembly to its retracted position against the action of said spring, or to allow said one cutter assembly to so move to its retracted position.

Preferably the construction and arrangement is such that, when the jam has been cleared, the said one cutter assembly automatically returns to its advanced position.

Figure 1:
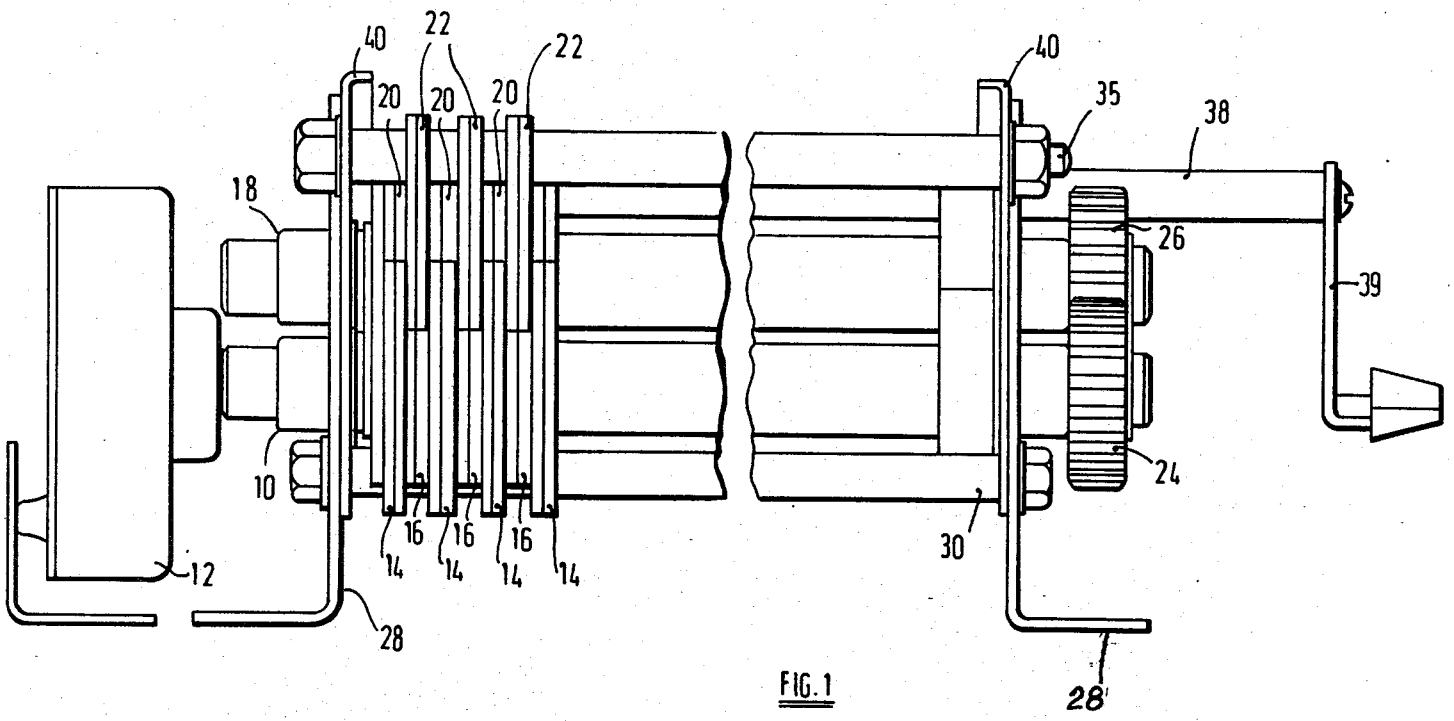
FIG. 1 is a side elevation of a document shredding machine which is a preferred embodiment of this invention, and which has been selected for the purposes of illustrating the invention by way of example.

The machine which is the preferred embodiment of this invention is specifically a document shredding machine of the kind specified, comprising first and second cutter assemblies 6, 8 respectively. The first cutter assembly comprises a hexagonal drive shaft 10, connected to the output of a drive motor 12, and cutter discs 14 mounted on the shaft 10 at spaced intervals determined by stripper members 16. The cutter assembly 8 similarly comprises a drive shaft 18, and cutter discs 20 mounted on the shaft 18 at spaced intervals determined by stripper members 22.

At an end portion remote from the drive motor 12 the shaft 10 is provided with a gear wheel 24 which, during normal operation of the machine, is in meshing engagement with a gear wheel 26 secured to the drive shaft 18. Thus, the drive motor 12 is operative to rotate the drive shaft 10 in one direction, and the drive shaft 18 in the opposite direction through the gear wheels 24, 26.

The discs of each cutter assembly enter the gaps between the discs of the other cutter assembly, the thickness of the stripper members 16 and 22 being such that there is little or no clearance between the discs. Material fed into the nip between the cooperating cutter discs (FIG. 2) is shredded by the cooperating cutter assemblies into narrow strips, being deposited in a bin (not shown) placed beneath the cooperating cutter assemblies.

The first cutter assembly 6 is secured to a machine frame by tie rods 30, 31 passing through the stripper members 16 and through side plates 28 of the machine frame; in this manner, the first cutter assembly is maintained in fixed relationship relative to the machine frame. The second cutter assembly comprises carrier plates 40, and is secured to the machine frame 28 by a single tie rod 34 which passes through the carrier plates 40, through the stripper plates 22 and through the side plates 28 of the machine frame, and a tie rod 35 which passes through the carrier plates 40, through the stripper plates 22, but not through the side plates 28 (see FIG. 2). Thus, the second cutter assembly is mounted on the machine frame for pivotal movement about the axis of said tie rod 34.

Extending between part of the first cutter assembly and part of the second cutter assembly is a strong tension spring 36, adapted to urge the second cutter assembly towards the first cutter assembly into a normal working position, determined by engagement of the second cutter assembly with a stop (not shown).

Figure 2:
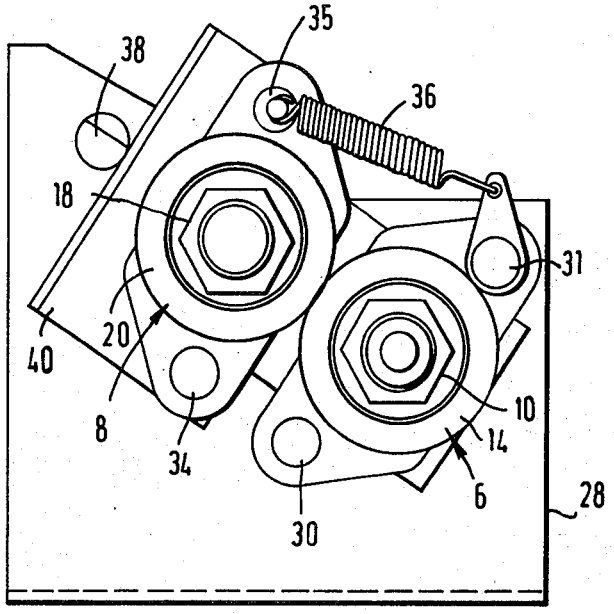
FIG. 2 is an end elevation, showing the machine in its normal working condition.
Figure 3:
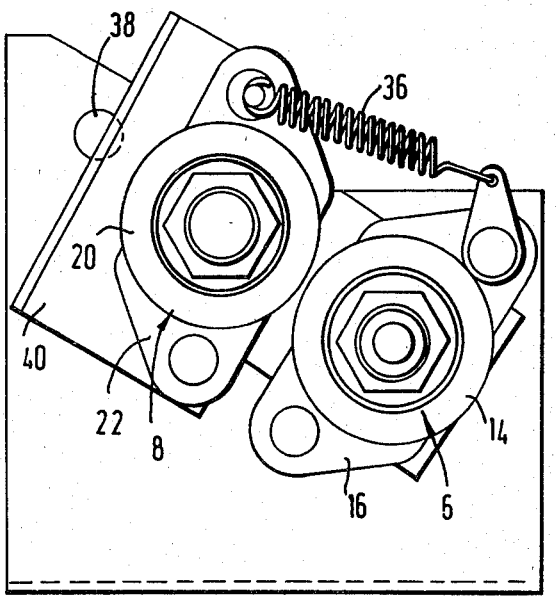
FIG. 3 is an end elevation, showing the position adopted by one of the cutter assemblies of the machine, when the machine is being unjammed.

The machine which is the preferred embodiment of this invention comprises a manually operable release device, comprising a shaft 38, which affords a stop of the device, carried by the machine frame and mounted for rotation in bores thereof by a handle 39 (see FIGS. 1 and 3). In the normal working condition of the release device, the shaft 38 bears against the carrier plates 40 of the second cutter assembly, preventing movement of said cutter assembly 8 from its normal working condition. However by rotation of the handle 39, the shaft 38 may be rotated, moving a cut-away portion of the shaft into opposition with said carrier plates 40 allowing the carrier plates, and hence the second cutter assembly, to move about the axis of the tie rod 34 against the action of the spring 36 by a small, predetermined increment. The handle 39 of the release device is however urged by a spring (not shown) to adopt a position in which the shaft 38 adopts the position shown in FIG. 2.

During normal running of the machine, documentary material such as paper is fed into the nip, and is shredded in conventional manner. However in the event of documentary material jamming between the cutter discs, the handle 39 may be moved manually to rotate the shaft 38 to the position shown in FIG. 3, allowing the second cutter assembly 8 to move away from the first cutter assembly, opening the nip between the two sets of cutter discs. The degree of permitted movement of the second cutter assembly (determined by the extent of the reduction of the shaft 38) is insufficient to take the gear wheel 26 out of engagement with the gear wheel 24, and consequently during such movement of the second cutter assembly, the shaft 18 thereof continues to rotate, feeding material jammed between the two cutter assemblies through the nip and into the bin.

The separated position adopted by the second cutter assembly 8 is shown in FIG. 3 to be such as to withdraw the cutter discs of the two assemblies from overlapping relationship. Thus, some material being fed through the nip whilst the second cutter assembly is in its retracted position will not be shredded. However if desired the degree of movement of the second cutter assembly may be limited to an extent, which although sufficient to open the nip slightly, and consequently to allow passage of jammed material through the machine, is insufficient to take the cutter discs from their overlapping relationship. Thus, material which is fed through the nip on operation of the release device, passes into the bin in shredded condition.

Upon completion of unjamming of the machine, the spring 36 urges the second cutter assembly back to its normal operating position, moving the carrier plates from engagement with the shaft 38. The shaft 38 consequently rotates, returning to its normal working position as shown in FIG. 2.

Although the invention has been described hereinabove in relation to a machine comprising a drive motor operative in one direction only, the invention can be used in a machine comprising a motor having a reverse drive facility.

I claim:

1. A document shredding machine of the kind comprising a machine frame, two cutter assemblies each comprising a shaft mounted on the frame and cutter discs mounted on the shaft at spaced intervals, the shafts being substantially parallel and spaced apart a distance such that the discs on one shaft extend into the spaces between the discs on the other shaft into overlapping relationship and form a nip, the machine comprising drive means mounted on the frame which is operative to rotate the shafts in opposite directions so that documentary material fed into the nip of the machine is cut into strips by the action of the overlapping discs, the improvement wherein one of the cutter assemblies is mounted so as to be capable of separative movement relative to the other cutter assembly against the action of resilient means, the machine including stop means on the machine frame which may be moved between a stop position in which it maintains the two cutter assemblies in prefixed overlapping relationship and prevents such relative separative movement and a release position in which such relative separate movement against the action of the resilient means is permitted, said stop means when in its release position limiting the separative movement to an extent so as to maintain the cutter discs of the two assemblies in said overlapping relationship.

2. The invention according to claim 1 wherein one of the cutter assemblies is fixedly mounted on the frame, and the other is mounted for limited movement away from the fixed cutter assembly.

3. The invention according to claim 1 wherein the movable cutter assembly is mounted on the frame for movement towards and away from the fixed cutter assembly about a pivot axis.

4. The invention according to claim 1 wherein the drive means is arranged to continue to operate, to rotate at least one of the shafts, when the cutter assemblies are so separated.

5. The invention according to claim 1 wherein said resilient means is afforded by a tension spring connected to and extending between the cutter assemblies.

6. A document shredding machine according to claim 1 wherein:

one of the cutter assemblies is fixedly mounted on the frame;

the other cutter assembly is mounted on the frame for pivotal axial movement towards and away from the fixedly mounted assembly;

the drive means including gears intermeshing with each other on the shafts supporting the fixed and movable cutter assemblies; and wherein the amount of pivotal movement permitted by said one cutter assembly retains the gears in said intermeshing arrangement.

* * * * *